United States Patent [19]

Perry

[11] Patent Number: 5,025,712

[45] Date of Patent: Jun. 25, 1991

[54] CHIMNEY COVER APPARATUS

[76] Inventor: Kevin D. Perry, #28 Lisa La., Mashpee, Mass. 02649

[21] Appl. No.: 401,819

[22] Filed: Sep. 1, 1989

[51] Int. Cl.[5] ..... F23L 11/00

[52] U.S. Cl. ..... 98/59; 98/67

[58] Field of Search ..... 55/507; 98/59, 67, 85

[56] References Cited

U.S. PATENT DOCUMENTS

| | | | |
|---|---|---|---|
| 533,995 | 2/1895 | Mackert | 98/67 |
| 2,295,839 | 9/1942 | Grigsby | 98/59 |
| 2,976,796 | 3/1961 | Anthony et al. | 98/67 |
| 3,017,954 | 1/1962 | Kruckewitt | 55/507 |
| 3,921,509 | 11/1975 | Curry et al. | 98/59 |
| 4,256,257 | 3/1981 | Pinkerton | 98/59 X |
| 4,436,021 | 3/1984 | Hisey | 98/67 |
| 4,534,280 | 8/1985 | Hisey | 98/67 |
| 4,535,686 | 8/1985 | Hisey | 98/67 |
| 4,549,473 | 10/1985 | Alexander et al. | 98/67 |

*Primary Examiner*—Harold Joyce

*Attorney, Agent, or Firm*—Thomas A. Kahrl

[57] ABSTRACT

An improved chimney cover system and method for controlling the flow of smoke. The chimney cover including a peaked roof supported by moveable arms mounted on a mounting band received by a chimney flue, including a dome shaped screen and outwardly facing prongs for secure attachment to the flue, where in the peaked roof is moveable in a vertical axis with respect to the flue.

5 Claims, 1 Drawing Sheet

CHIMNEY COVER APPARATUS

BACKGROUND OF THE INVENTION

The covering of chimneys associated with dwellings is important in preventing water and snow from entering the chimney flue and causing damage as well as preventing small animals and birds from gaining access to the dwelling via the chimney flue. Generally chimney covers are employed to provide shelter to keep rain and snow out of a chimney flue. Often the means provided for fitting the conventional cover can be dislodged by animals such as raccoons, to gain entrance to a house for food or shelter, and once in, cause much damage to the contents of the dwelling. Often chimney covers are attached with screws and require holes to be drilled in the ceramic chimney flue with substantial risk of cracking and damage to the flue.

Chimney covers or alternatively chimney caps of which applicant is aware are shown in U.S. Pat. Nos. 4,436, 021, 4,534, 280, 832,1 888, 1,490,186, 2,805,616, 4,549,473 and 4,487,112.

It is desirable however to provide for an improved, simple, yet effective chimney cover to provide for the improved attachment to the chimney with the combined feature of preventing entry by animals while emitting smoke and provide for adjustment of the roof of the cover with respect to the chimney to improve the flue draft and prevent down drafts resulting in smoke entering the house rather than exiting the fireplace via the chimney flue.

SUMMARY OF THE INVENTION

The present invention is directed to an improved chimney cover, a chimney cover system employing the improved chimney cover and a method of controlling the flow of smoke employing the improved chimney cover of the invention.

The present invention comprises an improved chimney cover which includes an adjustably mounted roof mounted over a dome-shaped screen, attached to a mounting band having a discontinuity, adapted to be positioned on the top of a chimney flue, and to prevent entrance thereto by small animals or birds. The chimney cover is provided with a plurality of paired support arms to adjustably support the roof in relation to the top of the chimney flue. The mounting band is typically of metallic construction is generally rectangular in shape, and is provided with a discontinuity on each side comprising a right hand and a left hand slide bar each having elongated slots for engaging rivet fasteners. The wire mesh attached at a plurality of points to the metallic band, is formed with a dome shape to prevent settling of debris on it's center or axis portion and to provide natural resilience serving to produce an outward tension on the mounting band and prongs mounted thereon to fit a plurality of chimney flue sizes.

The mounting band comprises a plurality of prongs, preferably metallic in the preferred embodiment, with an inverted J shape, oriented outward naturally and capable of contacting the interior as well as exterior wall of a chimney flue to secure and immobilize the present invention therein.

The user of the chimney cover may select the desired height of the roof relative to the chimney flue depending on the prevailing wind drafts to improve the updraft in the flue to better evacuate smoke from the fireplace provided in communication with the chimney flue.

Alternatively for periods of nonuse, the roof may be lowered to completely enclose the top of the flue.

As also contemplated by the invention, the improved chimney cap may be employed to provide protection as a spark arrester to reduce the risk of fire by the action of the wire mesh and by controlling the air flow of the updraft to reduce the build up of creosote on the inner surfaces of the chimney flue. In addition the folding feature of the adjustable support arms permits compressing the present invention to a compact form for ease of packaging.

The chimney cover of the invention may be employed in a chimney cover system whereby the amount of down draft of air from outside the chimney and smoke laden updraft air rising upwardly from a fireplace connected to the chimney flue is controlled by adjusting the height of the roof of the present invention and hereby changing the size of the opening provided by the chimney cover.

The invention also includes a method for the controlled flow of smoke laden air or other vapor, particularly products of combustion occurring in an associated fireplace, from the smoke laden air of vapor source which method would comprise providing the improved chimney cover and adjusting the size of the opening between the top of the cover consisting of the roof and the top of the flue as required to provide for the desired flow of the air from the interior of the chimney flue and to provide for the reduction of the desired flow of the air from the exterior of the chimney flue in the form of a down draft.

The invention will be described for the purposes of illustration only in connection with certain embodiments; however, it is recognized that those ments and additions on the illustrated embodiments all without departing from the spirit and scope of the invention.

DESCRIPTION OF THE EMBODIMENTS

Figure 1:
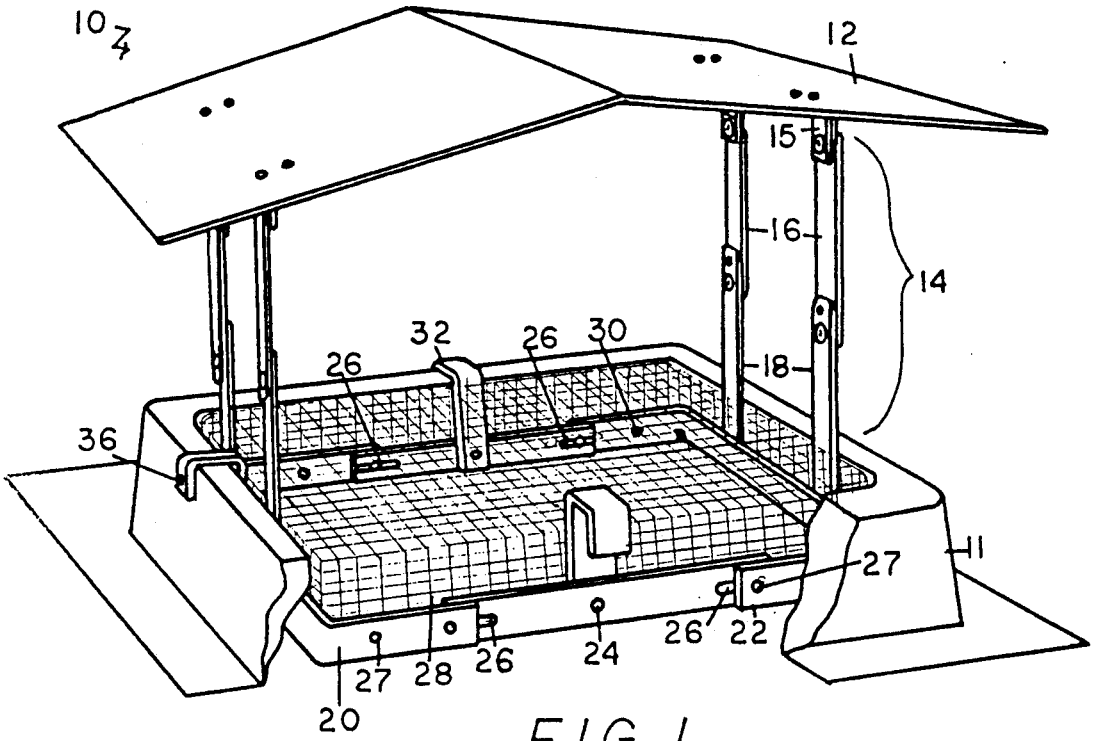
FIG. 1 is an isometric view of the chimney cover of the invention.
Figure 2:
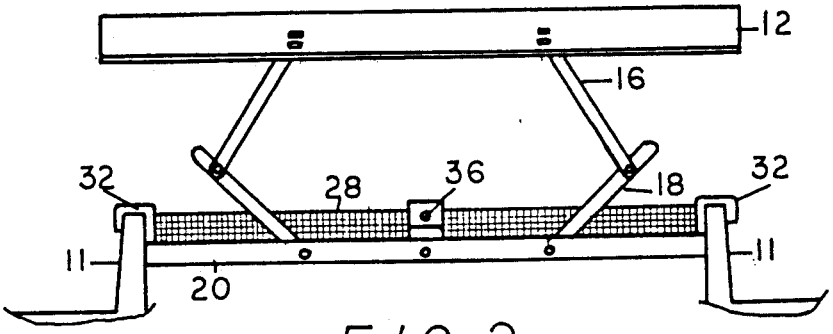
FIG. 2 is a side elevational view of the chimney cover of FIG. 1; with the roof in a partially folded position.
Figure 3:
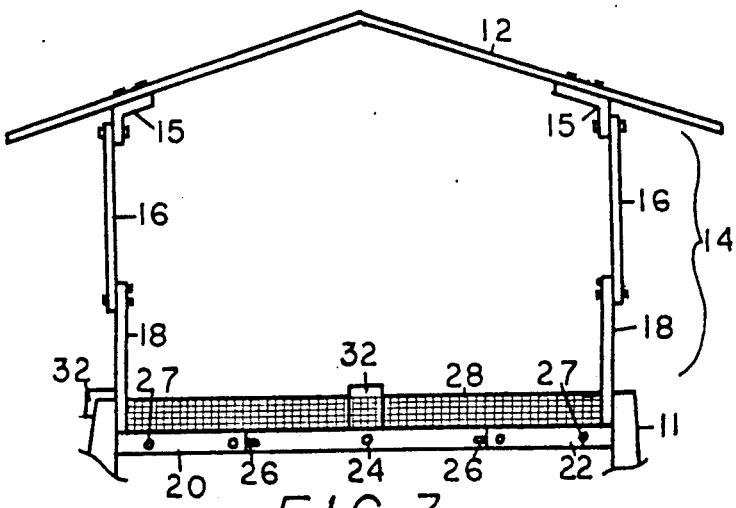
FIG. 3 is a side elevational view of the chimney cover of FIG. 1 with the roof shown in the full upright position.

With reference to the drawings, FIG. 1 shows a chimney cover system including a chimney cover 10, installed in a chimney flue 11, comprising a peaked roof 12 in the fully up-right extended position supported by a plurality of support members 14, each support member including an upper arm 16, moveably joined to a lower support arm 18. Each upper arm 16 is moveably attached to the underside of the peaked roof 12, in the preferred embodiment. There are two pairs of support members 14 positioned on opposite sides of a mounting band member 20, such that as the roof 12 is foldably compressed toward the mounting band 20. The support members 14, with a knee action, bend outwardly and away as upper arm 16 and lower support 18 moveably flex at the conventional rivet means provided at. The upper arm 16 has an upper end and a lower end. The lower end being moveably riveted to the upper end of the lower support arm 18 to provide a moveable knee action shown in FIG. 2. The mounting band 20, of generally rectangular construction, comprises a plurality of an arched section 22 sliding bars 24, each having elongated slots 26 for slideably engaging rivet fasteners with prongs 32 securely mounted thereon; mounted within mounting band 20 and fixed by secured thereto, is a dome shaped screen 28 constructed of wire mesh of a size to completely cover conventional chimney flue. The prongs 32, four in number, two placed at the mid point of the arched sections 22, and two at the mid point of slide bars 24, extend outwardly to engage by compression find chimney flue 11. The mounting band 20 may be compressed against the normal outwardly urging force of the band wire mesh construction of the screen for insertion in the flue, where upon the mounting band 20 tightly engages the inner surface of the flue 11. Set screw 36 are provided to lock the prong in secure attachment with the flue 11.

What is claimed is:

1. A chimney cover apparatus for installation in a chimney flue, which system comprises in combination;

a) a roof extending over the top of the chimney flue in adjustable spaced relationship thereto;

b) a barrier device for prevention of entry by animals comprising;

i) a flexible mounting means for permitting manual insertion and installation of the chimney cover apparatus in the chimney flue comprising;

1) an expandable band of general rectangular shape for telescopic insertion in the flue having a one end and other end comprising;

a first arched section positioned at the one end;

a second spaced apart arched section positioned at the other end of the flue opposite the first section;

a plurality of slide bars having each a one end and an other end with a slot adjacent each end for connecting the first and second arched section for movement thereof between a compressed position and an open engaged position;

ii) a spring means connected to the expandable band, constructed of resilient wire mesh for providing a barrier against entry by animals enclosed within the expandable band for constantly urging the first and second arched sections outwardly for providing clamping of the expandable band engagement against the inner surface of the flue;

iii) connecting means for slideably connecting the first and second arched sections to the slide bars;

c) a plurality of prong means for engaging the top peripheral wall surface of the flue fastened securely to each arched segment and each slide bar;

d) a plurality of support arm members the one end secured to the roof and the other end hingeably attached to the flexible mounting band and provided with intermediate hinge means for adjustable mounting of the roof between an open position and a variable position to adjust the amount of draft in the flue; whereby the barrier device may be installed in the chimney by compressing the flexible mounting means inwardly, inserting the mounting means in the flue with the prongs engaging the top peripheral wall surface of the flue for positioning the barrier device relative to the chimney, next releasing the mounting means to be urged outwardly to securely engage the inner wall of the flue, with sufficient force to resist efforts by animals seeking to dislodge the chimney cover apparatus and gain entry into the chimney.

2. The apparatus of claim 6 wherein the expandable band may be compressed by manual operation by moving the first and second arched sections from the open position to the compressed position.

3. The apparatus of claim 6 wherein the spring means comprises a wire mesh in the form of an inverted basket securely fastened to the expandable band and is constructed of resilient metallic material.

4. The apparatus of claim 6 wherein the connecting means comprises a plurality of rivets attached to the arched sections and extending through slots provided in the slide bars for slideable connection of the arched sections to the slide bars.

5. A chimney cover apparatus for installation in a chimney flue, which system comprises in combination;

a) a roof extending over the top of the chimney flue in adjustable spaced relationship thereto;

b) a flexible mounting band of generally rectangular shape for telescopic insertion in the flue having a one end and an other end and a first and second side and provided with a discontinuity on each side comprising;

i) a first arched section constructed in a "U" shape positioned at the one end of the flexible mounting band;

ii) a second arched section constructed in a "U" shape at the other end of the flexible mounting band;

iii) a first slotted side bar having a one and other end with a longitudinal slot adjacent each end;

iv) a second slotted side bar having a one and other end with a longitudinal slot adjacent each end;

v) a plurality of rivets for slideably attaching the arch sections to the slide bars providing for slideable longitudinal movement between a compressed position and an open engaged position;

c) a plurality of support arm members the one end secured to the roof and the other end hingeably attached to the flexible mounting band and provided with intermediate hinge means for adjustable mounting of the roof between an open position and a variable position to adjust the amount of draft in the flue;

d) a screen means for preventing access by animals mounted within and securely attached to the flexible mounting band having an inverted basket shape and constructed of resilient metallic material in a basket shape enclosed within the flexible mounting band;

e) a plurality of prongs mounted on each side of the mid section of each arch section and each slotted side bar whereby on manual insertion of the chimney cover apparatus in the flue, the screen means acts to urge the flexible mounting band against the flue firmly enough to prevent dislodging by an animal seeking to gain entry in the chimney flue;

* * * * *